United States Patent [19]

Greer

[11] Patent Number: 4,667,347

[45] Date of Patent: May 26, 1987

[54] SWING AWAY POCKET

[76] Inventor: William K. Greer, Rt. 6, Knollwood Dr., Greenville, S.C. 29607

[21] Appl. No.: 875,979

[22] Filed: Jun. 19, 1986

[51] Int. Cl.[4] ..... A41D 27/20

[52] U.S. Cl. ..... 2/247; 2/250; 2/254

[58] Field of Search ..... 2/247, 248, 249, 250, 2/251, 252, 253, 254

[56] References Cited

U.S. PATENT DOCUMENTS 2,557,445 6/1951 Lewallen ..... 2/247

2,604,627 7/1952 Abbott ..... 2/247

*Primary Examiner*—Doris L. Troutman

*Attorney, Agent, or Firm*—Bailey & Hardaway

[57] ABSTRACT

An auxilliary apparatus is illustrated having placement within the top pocket of a shirt or coat which utilizes a relatively stiff flap for retention within the top garment pocket, overlying the top pocket, while an outer pocket constructed of textile material is hinged to the relatively stiff flap to swing outwardly when the wearer leans forwardly to prevent articles carried within the auxilliary device from falling out.

3 Claims, 4 Drawing Figures

SWING AWAY POCKET

BACKGROUND OF THE INVENTION

Most wearers of garments having top pockets in which they carry articles such as glasses, cigarettes, cigarette lighters, golf tees or other objects within their top pockets have problems when they lean over in that such articles often fall from the pockets. This also often happens when a glasses wearer places his glasses within his coat pocket so that when the coat is removed or put on, the glasses have a tendency to fall out of the pocket.

A problem has been heretofore noted in connection with pocket watches, and a swing away pocket has been illustrated in U.S. Pat. No. 2,011,010 wherein accommodations are also provided for retaining a writing instrument. The auxilliary or swing away pocket of the patent has an upper portion which is sewn to the garment of the wearer and is not associated with the top pocket of the garment, and no means are provided for removing or temporarily securing the auxilliary pocket in the top pocket of the garment.

Accordingly, it is an important object of the present invention to provide a swing away pocket for carrying articles adjacent the top pocket of a garment which may be temporarily attached to the top pocket and readily removed therefrom when not in use.

Another important object of the invention is the provision of an auxilliary garment pocket which lends itself to display merchandising for temporary use within a top pocket of a garment and which may be temporarily retained therein.

SUMMARY OF THE INVENTION

A swing away pocket has been provided which retains articles wherein the entire device may be temporarily retained within the top pocket of a garment but which may be readily removed after the garment is worn or when desired. The auxilliary swing away device employs a relatively stiff flap constructed of sheet material such as cardboard or plastic and sized to fit within a top pocket of a garment. A pocket portion is constructed of textile material having an open upper end formed between a front panel and a rear panel. Means are provided for hinging the pocket constructed of textile material to the relatively stiff flap along an upper edge of said rear panel. The flap is sized for retention within the shirt pocket against a force acting along an upper edge of the top pocket when in use by a wearer tending to dislodge same from the top pocket. Preferably, the hinged means includes a tab extending outwardly from the inner panel passing over an upper edge of the flap for sewing thereon and which may contain slots for retaining pens, pencils and the like.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a swing away pocket for retaining articles including a relatively stiff flap A constructed of sheet material sized to fit within a top pocket of a garment. A pocket B is constructed of textile material having an open upper end formed between a front panel and a rear panel. Means C is provided for connecting an upper edge of the flap to an upper edge of the rear panel. The flap is sized for retention within the top pocket against a force acting along an upper edge of the top pocket as would be caused by a pair of glasses and the like when the wearer of the garment leans forwardly causing the pocket to swing out from the garment remaining upright due to gravity whereby the article is retained within the swing away pocket.

Figure 1:
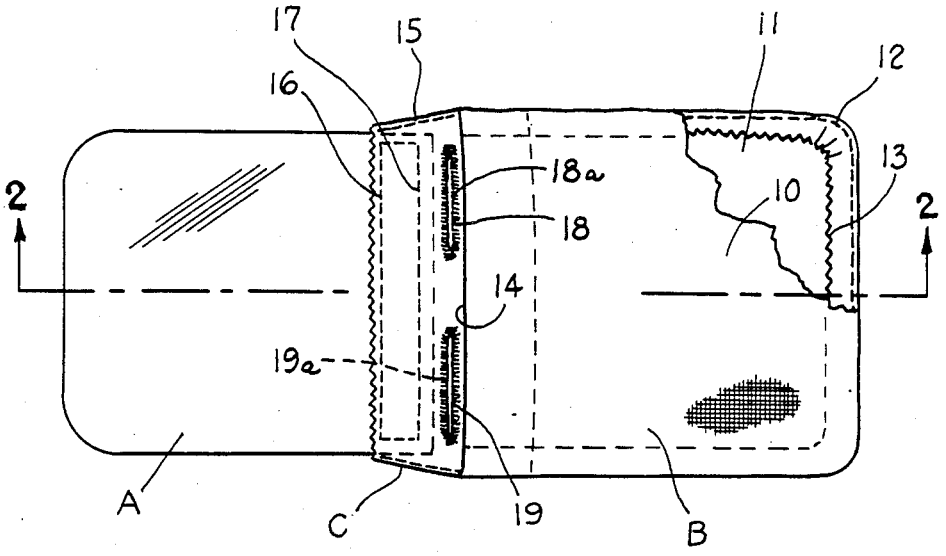
FIG. 1 is a plan view looking toward the front panel of the auxilliary pocket with the flap hinged thereto in accordance with the invention.
Figure 2:
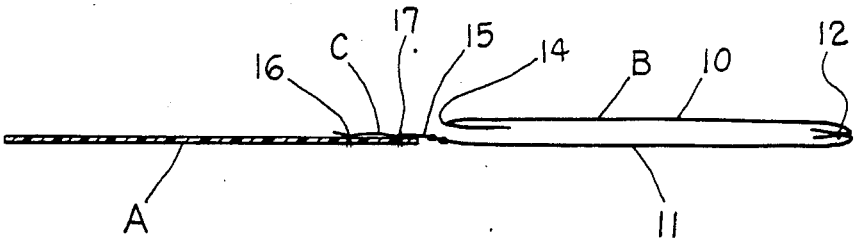
FIG. 2 is a transverse sectional elevation taken on the line 2—2 in FIG. 1.

Referring more particularly to FIG. 1, it will be observed that the relatively stiff but flexible flap A is constructed of sheet material which may be plastic or cardboard and the like. The swing away pocket or auxilliary pocket portion B is constructed of textile material which may be of any relatively thin flexible natural or synthetic sheet material although woven material is preferred. The pocket B includes a front panel 10 and a rear panel 11 which are sewn together by a row of stitches 12 leaving free edges 13. The pocket has an open top at an upper edge 14 and a means C is provided for connecting an upper edge of the flap to an upper edge of the rear panel and includes a tab 15 which overlies an adjacent or upper portion of the flap A and is sewn thereto by two lines of stitching 16 and 17. The tab 15 intermediate the flap A and the pocket B carries elongated slots 18 and 19 in alignment with the upper portion 14 of the pockets defining elongated slots in alignment with the upper portion of the pocket and having reinforcing stitches **18*a* and 19*a*** about the borders of the slots.

Figure 3:
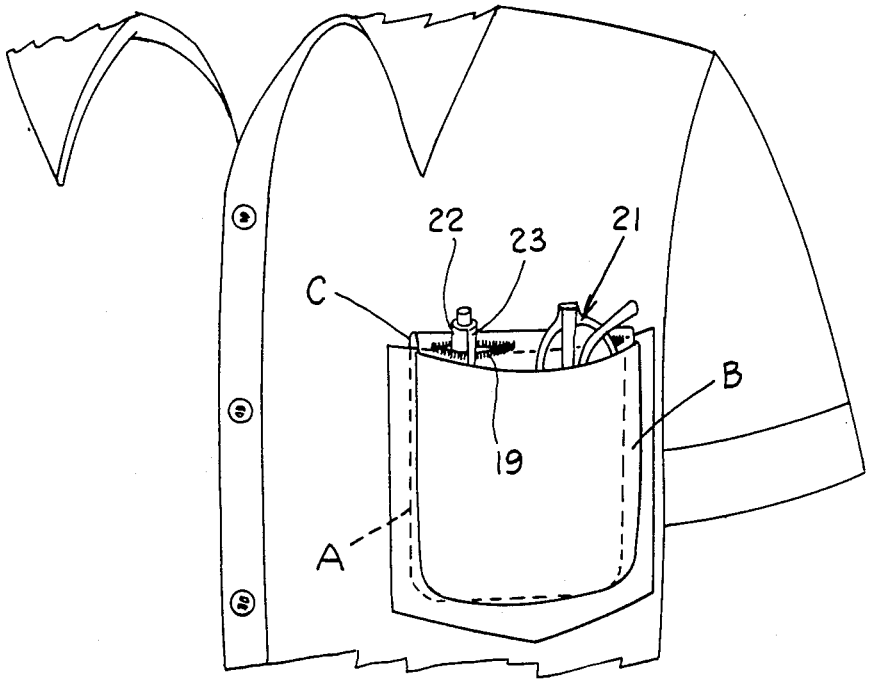
FIG. 3 is a perspective view illustrating a device of FIGS. 1 and 2 of the top pocket of a wearer's shirt.

FIG. 3 illustrates the use of the swing pocket apparatus with an upper pocket 20 of a garment. While a shirt is illustrated, the upper pocket 20 may be a coat pocket and the like. A pair of glasses designated at 21 illustrated within the pocket and a pen 22 has a clip 23 for securing same within one of the slots 19. It will be observed that the relatively stiff flap A is sized to fit within a top pocket of a garment secured snugly or at least to an extent to permit retention within the top pocket against a force tending to dislodge the apparatus from the pocket upon the wearer bending over to an excessive degree.

Figure 4:
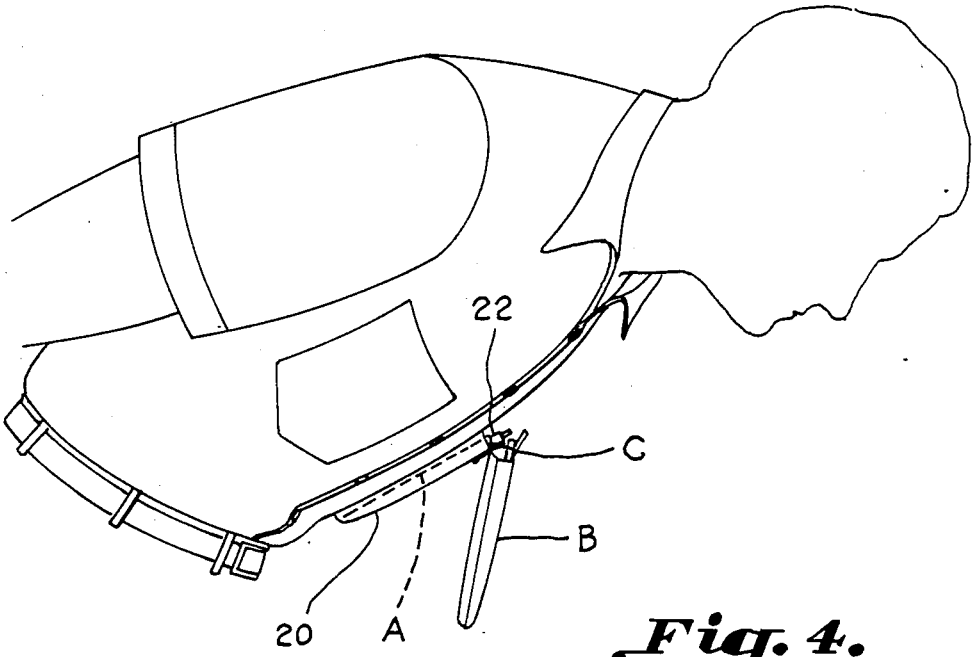
FIG. 4 illustrates the swing away pocket at a reduced scale in a depending or vertical position which is swung away from the top pocket of the garment of the wearer when the wearer bends over.

FIG. 4 illustrates the swing away pocket in vertical position although the user has bent over causing the upper pocket 20 to incline whereby the auxilliary pocket swings away with respect thereto or at least remains in the vertical position.

While a preferred embodiment of the invention has been described using specific terms, such description is for illustrative purposes only, and it is to be understood that changes and variations may be made without departing from the spirit or scope of the following claims.

What is claimed is:

1. A swing away pocket for retaining articles comprising:

a relatively stiff flap constructed of sheet material sized to fit within a top pocket of a garment;

a pocket constructed of textile material having an open upper end formed between a front panel and a rear panel;

means connecting an upper edge of said flap to an upper edge of said rear panel; and said flap being sized for retention within the top pocket against a force acting along an upper edge of the top pocket as would be caused by a pair of glasses and the like when the wearer of the garment leans forwardly causing the pocket to swing out from the garment remaining upright due to gravity;

whereby the article is retained within the swing away pocket.

2. The structure set forth in claim 1 wherein said means connecting an upper edge of said flap is an outwardly extending tab extending from an upper edge of said rear panel.

3. The structure set forth in claim 2 wherein said tab has at least one elongated slot for accommodating elongated articles therein.

* * * * *